US011505365B2

(12) United States Patent
Wang et al.

(10) Patent No.: US 11,505,365 B2
(45) Date of Patent: Nov. 22, 2022

(54) RESEALABLE EASY OPEN LID

(71) Applicant: SUZHOU SLAC PRECISION EQUIPMENT CO., LTD, Suzhou (CN)

(72) Inventors: Bingsheng Wang, Suzhou (CN); Yao Yao, Suzhou (CN)

(73) Assignee: SUZHOU SLAC PRECISION EQUIPMENT CO., LTD, Suzhou (CN)

( * ) Notice: Subject to any disclaimer, the term of this patent is extended or adjusted under 35 U.S.C. 154(b) by 88 days.

(21) Appl. No.: 17/158,150

(22) Filed: Jan. 26, 2021

(65) Prior Publication Data

US 2022/0127040 A1 Apr. 28, 2022

(30) Foreign Application Priority Data

Oct. 26, 2020 (CN) ..... 202011153620.0

(51) Int. Cl.
*B65D 17/28* (2006.01)

(52) U.S. Cl.
CPC .. *B65D 17/4014* (2018.01); *B65D 2517/0025* (2013.01); *B65D 2517/0044* (2013.01)

(58) Field of Classification Search
CPC ..... B65D 17/4014; B65D 17/4012; B65D 17/401; B21D 51/383
USPC ..... 220/272, 270, 266, 265, 906, 730; 413/14, 12, 8
See application file for complete search history.

(56) References Cited

U.S. PATENT DOCUMENTS

| | | | | |
|---|---|---|---|---|
| 2020/0407109 | A1* | 12/2020 | Vinger | B65D 17/34 |
| 2021/0039829 | A1* | 2/2021 | Ohkoshi | B21D 51/44 |
| 2021/0300623 | A1* | 9/2021 | Bratsch | B65D 17/4014 |
| 2022/0063864 | A1* | 3/2022 | Forrest | B65D 17/4012 |

FOREIGN PATENT DOCUMENTS

| | | | | |
|---|---|---|---|---|
| CN | 203381887 U | | 1/2014 | |
| TW | 201028341 A | * | 8/2010 | B65D 17/166 |

* cited by examiner

*Primary Examiner* — Robert J Hicks
(74) *Attorney, Agent, or Firm* — Oliff PLC

(57) ABSTRACT

A resealable easy open lid that is composed of a lid and a pull ring riveted on the lid; the rear end of the pull ring is composed of an outer ring body and an inner tongue of the pull ring; the tongue is provided with an arched deformation area along the edge; the arched deformation area is an edge inclined to the inner side of the lid which is formed by die stamping on the tongue of the pull ring; the tongue is provided with a part arching to the outside of the lid; after the pull ring is rotated around the riveting point, the tongue of the pull ring covers the opening zone, and when the middle part of the tongue is pressed, the arched deformation area can be overturned and deformed to make it contact with the edge of the opening area to seal the area.

3 Claims, 7 Drawing Sheets

RESEALABLE EASY OPEN LID

TECHNICAL FIELD

The invention relates to an easy open lid, in particular to a resealable easy open lid applicable for food.

BACKGROUND OF INVENTION

With the rapid development of economy and the improvement of people's living standards, people's demand for food and drink has been greatly grown. For the package of beverage in pop can, the design of easy open lid is the core point.

After the easy open lid of a traditional pop can of beverage is opened, it cannot be closed again because the tongue piece has been broken. If the beverage inside is not finished, foreign objects such as dust may enter the can, resulting in the beverage inside can no longer be drunk.

In view of the above problem that the easy open lid can not be resealed after being opened, the applicant of this case designed the resealable easy open lid many years ago. See CN203381887U invention patent in China Patent Announcement. The easy open lid disclosed in the patent is composed of a lid and a pull ring riveted on the lid, and the lid is provided with an main scribed line for opening the ring, and the area surrounded by the main scribed line is an opening area and the part in the opening area is the tongue of the can shell; the acting point of the front end of the pull ring acts on the tongue of the can shell in the opening area as one end of the lever, and the back end acts as the other end of the lever for the user to operate; the pull ring is made of a ring opening groove on a piece of sheet material, and the opening of the ring opening groove is toward the front end of the pull ring, so that the rear end of the pull ring is composed of an outer ring body and an inner tongue of the pull ring; and the area of the tongue of the pull ring is larger than the opening area, and the tongue of the pull ring covers the opening area after the pull ring is rotated around the riveting point.

The easy open lid disclosed in the invention patent achieves the function of resealing and blocking dust after opening, but in the resealing state, the tongue of the pull ring is only located above the opening area and there must be a gap between the tongue of the pull ring and the edge of the opening area, so the fit between the tongue of the pull ring and the opening area is poor and the sealing effect is limited.

DISCLOSURE OF THE INVENTION

The present invention provides a resealable easy open lid, which aims to improve the fit between the tongue of the pull ring and the opening area after the easy open lid is resealed, and improve the sealing effect.

In order to achieve the above objective, the technical solution adopted by the present invention is: A resealable easy open lid is composed of a lid and a pull ring riveted on the lid; and the lid is provided with an main scribed line for opening the ring, and the area surrounded by the main scribed line is an opening area and the part in the opening area is the tongue of the can shell; the acting point of the front end of the pull ring acts on the tongue of the can shell in the opening area as one end of the lever, and the back end acts as the other end of the lever for the user to operate; the pull ring is made of a ring opening groove on a piece of sheet material, and the opening of the ring opening groove is toward the front end of the pull ring, so that the rear end of the pull ring is composed of an outer ring body and an inner tongue of the pull ring;

The tongue of the pull ring is provided with an arched deformation area along the edge, and the arched deformation area is a ring opening belt along the ring opening groove, and its shape and size are matched with the shape and size of the opening area; the arched deformation area is an edge inclined to the inner side of the lid which is formed by die stamping on the tongue of the pull ring; In addition, the middle part of the tongue of the pull ring is provided with an arch that arches outwards towards the cover;

In the use state, when the pull ring is rotated around the riveting point to make the tongue of the pull ring cover the opening zone during the resealing, and when the middle part of the tongue of the pull ring is pressed by external force, the arched deformation area can be overturned and deformed to make it contact with the edge of the opening area to seal the opening area.

In above-described technical solution, the width of the arched deformation area accounts for 8% to 15% of the radial dimension of the tongue of the pull ring.

In above-described technical solution, the height at which the arched deformation area is inclined to the inner side of the lid is 0.8 to 2 times of the thickness of the tongue of the pull ring.

In above-described technical solution, the shape and size of the arched deformation area are required to be matched with the shape and size of the opening area, which means the shape of the arched deformation area shall be matched with that of the opening area and the size shall also be matched to ensure that the arched deformation area just covers the edge of the opening area. The specific shape of the opening area is not limited, and can be round, oval, rectangular or other irregular shapes, and the shape of the arched deformation area (or the tongue of the pull ring) should be matched with the opening area and cover the edge of the opening area, and the size of the arched deformation area (or the tongue of the pull ring) should be slightly larger than the opening area.

The present invention adopts three measures: 1. An arched deformation area is designed on the edge of the tongue of the pull ring, and the arched deformation area is stamped to make the edge of the tongue of the pull ring incline to the inner side of the lid in advance, and the strength of this area is weakened due to the additional stamping; 2. The shape and size of the arched deformation area are designed to match the shape and size of the opening area, so that the arched deformation area just covers the edge of the opening area; 3. An arched part is added on the middle part of the tongue of the pull ring to increase the strength of the middle part of the tongue of the pull ring. Due to the combined action of the above three measures, when the tongue of the pull ring is used to cover the opening area during the resealing, and the external force is applied to press the middle part of the tongue of the pull ring, the arched deformation area is overturned and deformed upward after it touches the edge of the opening area, so that the inner side of the arched deformation area and the edge of the opening area will reach line contact, which greatly improves the fit between the tongue of the pull ring and the opening area, thereby improving the resealing effect.

1. Lid; 11. Main scribed line; 12. Opening area; 13. Tongue of the can shell;

2. Pull ring; 21. Ring opening groove; 22. Ring body; 23. Tongue of the pull ring; 231. Arched deformation area; 232. Arched part;

3. Riveting point;

4. Upper die core;

5. Lower die core.

SPECIFIC EMBODIMENT

With reference to the accompanying drawings and embodiment, the present invention will be described in detail.

Embodiment: Refer to FIG. 1-12

Figure 1:
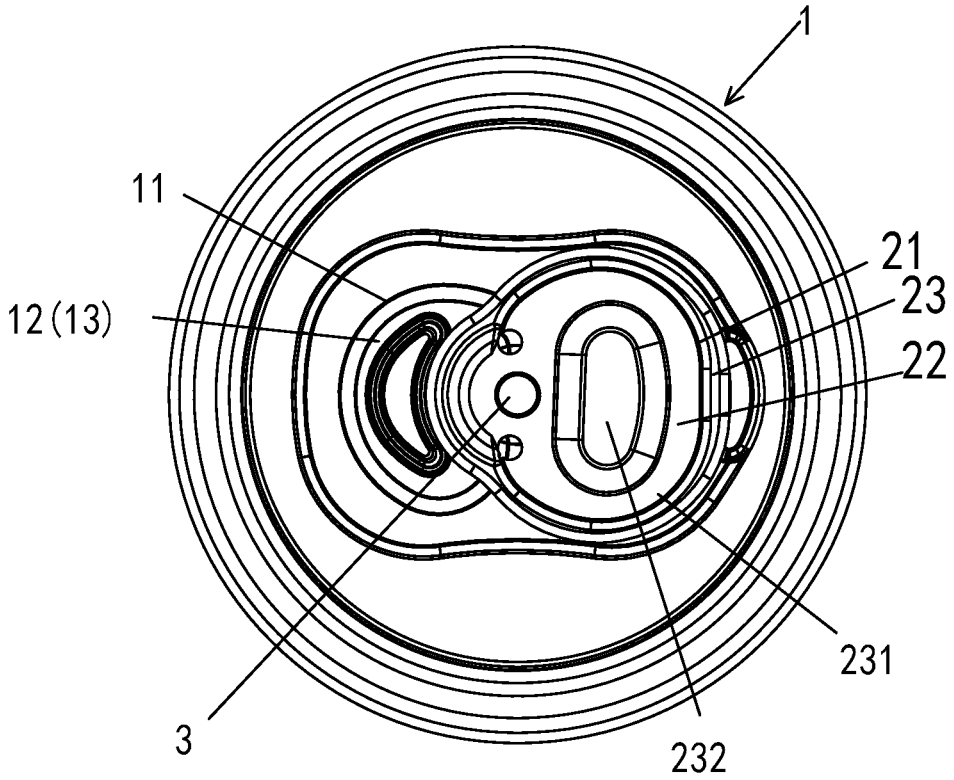
FIG. 1 is the main view of an embodiment of the present invention.
Figure 2:
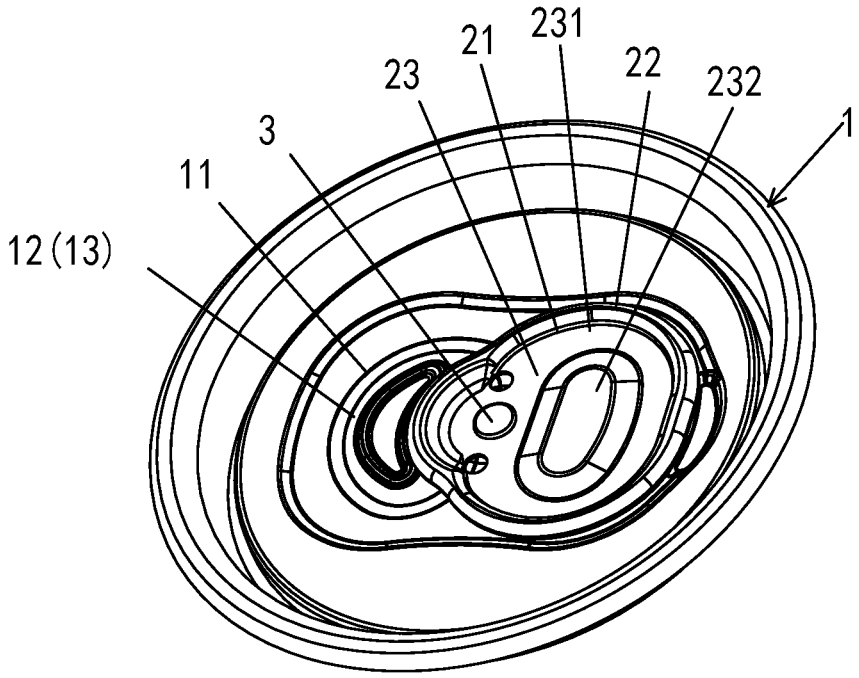
FIG. 2 is a perspective view 1 of an embodiment of the present invention, which shows an unopened state.
Figure 3:
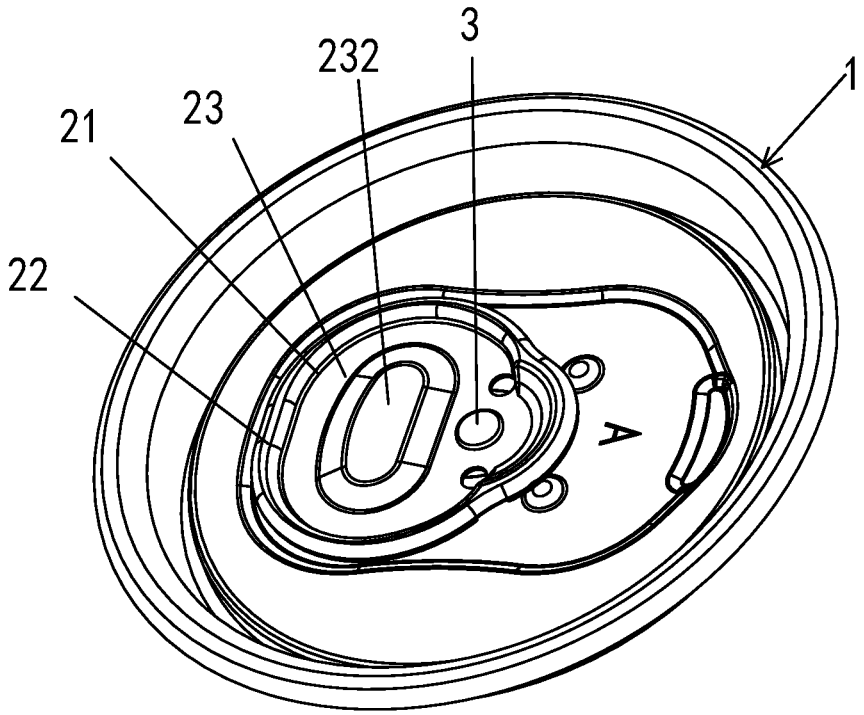
FIG. 3 is a perspective view 2 of an embodiment of the present invention, which shows a resealed state after opening.

A resealable easy open lid (as shown in FIG. 1-3) is composed of a lid 1 and a pull ring 2 riveted on the lid.

As shown in FIG. 1-3, the lid is provided with a main scribed line 11 for opening the ring, and the area surrounded by the main scribed line 11 is an opening area 12 and the part in the opening area 12 is the tongue of the can shell 13. The acting point of the front end of the pull ring 2 acts on the tongue of the can shell 13 in the opening area 12 as one end of the lever, and the back end acts as the other end of the lever for the user to operate.

Figure 4:
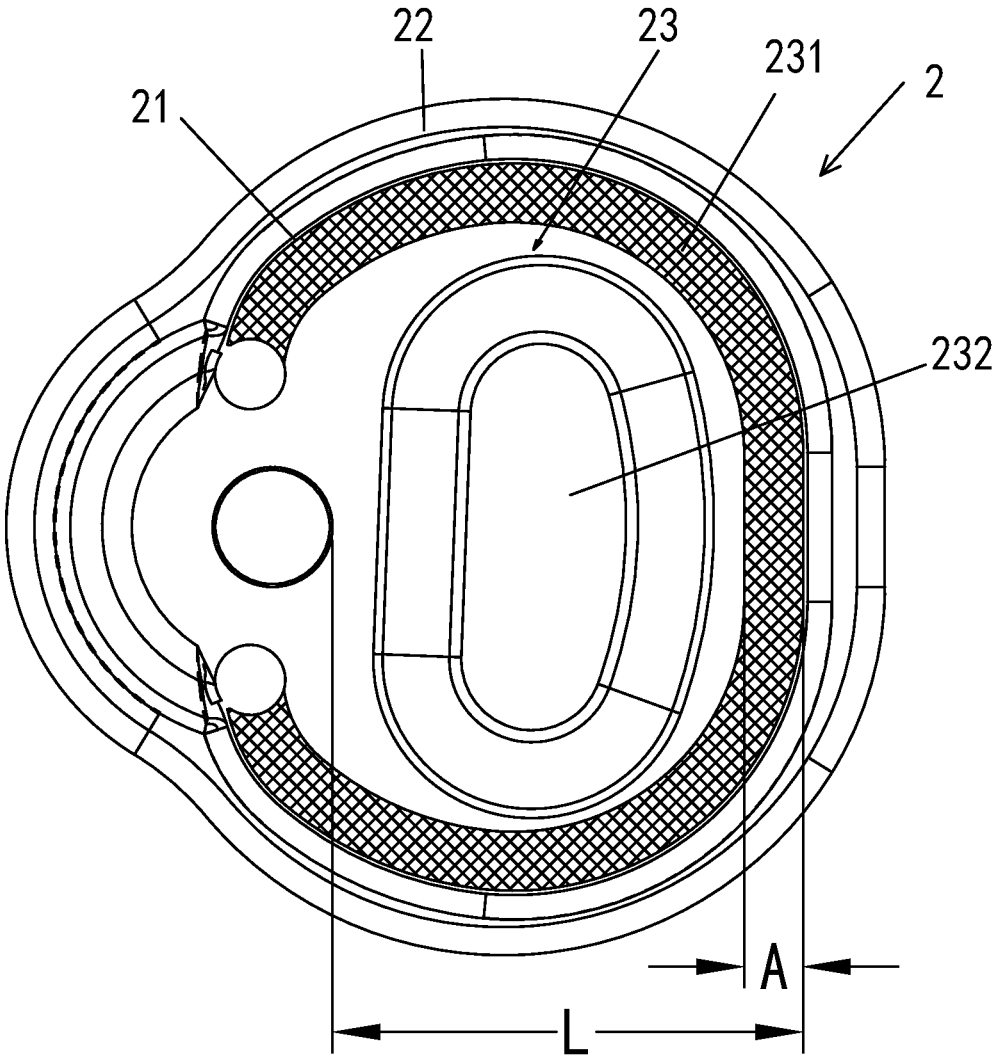
FIG. 4 is the main view of the pull ring of an embodiment of the present invention.
Figure 5:
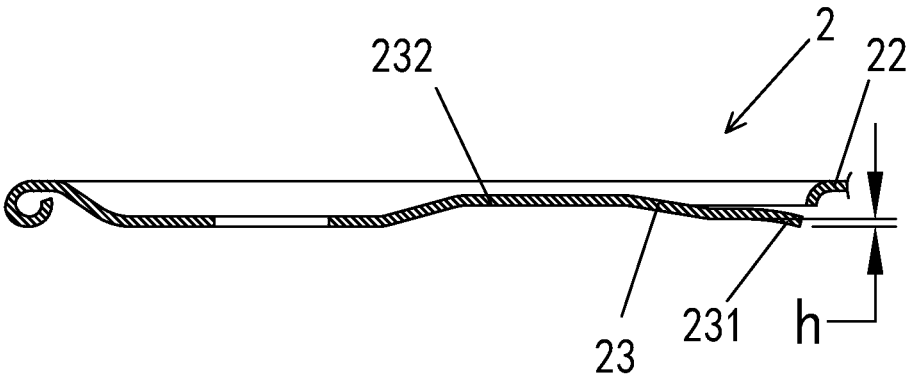
FIG. 5 is the top section view of FIG. 4.

As shown in FIGS. 4 and 5, the pull ring 2 is made of a ring opening groove 21 on a piece of sheet material, and the opening of the ring opening groove 21 is toward the front end of the pull ring 2, so that the rear end of the pull ring 2 is composed of an outer ring body 22 and an inner tongue of the pull ring 23.

As shown in FIGS. 4 and 5, the tongue of the pull ring 23 is provided with an arched deformation area 231 along the edge, and the arched deformation area 231 is a ring opening belt along the ring opening groove 21, and the arched deformation area 231 is indicated by a grid shadow area in FIG. 4.

The shape and the size of the arched deformation area 231 are matched with that of the opening area to ensure that the arched deformation area 231 can cover the edge of the opening area 12.

The arched deformation area 231 is an edge inclined to the inner side of the lid which is formed by die stamping on the tongue of the pull ring 23 as shown in FIG. 5, and the height (h) at which the arched deformation area 231 is inclined to the inner side of the lid is preferably 0.8 to 2 times of the thickness of the tongue of the pull ring 23.

As shown in FIGS. 4 and 5, In addition, the middle part of the tongue of the pull ring 23 is provided with an arch 232 that arches outwards towards the cover, and the specific shape of the arched part 232 is not limited and it could be any shape, and the function of the arched part 232 is to increase the strength of the middle part of the tongue of the pull ring 23.

In the use state, when the pull ring 2 is rotated around the riveting point 3 to make the tongue of the pull ring 23 cover the opening zone 12 during the resealing, and when the middle part of the tongue of the pull ring 23 is pressed by external force, the arched deformation area 231 can be overturned and deformed to make it contact with the edge of the opening area 12 to seal the opening area 12.

The width (A) of the arched deformation area 231 preferably accounts for 8% to 15% of the radial dimension (L) of the tongue of the pull ring 23, as shown in FIG. 4.

Figure 12:
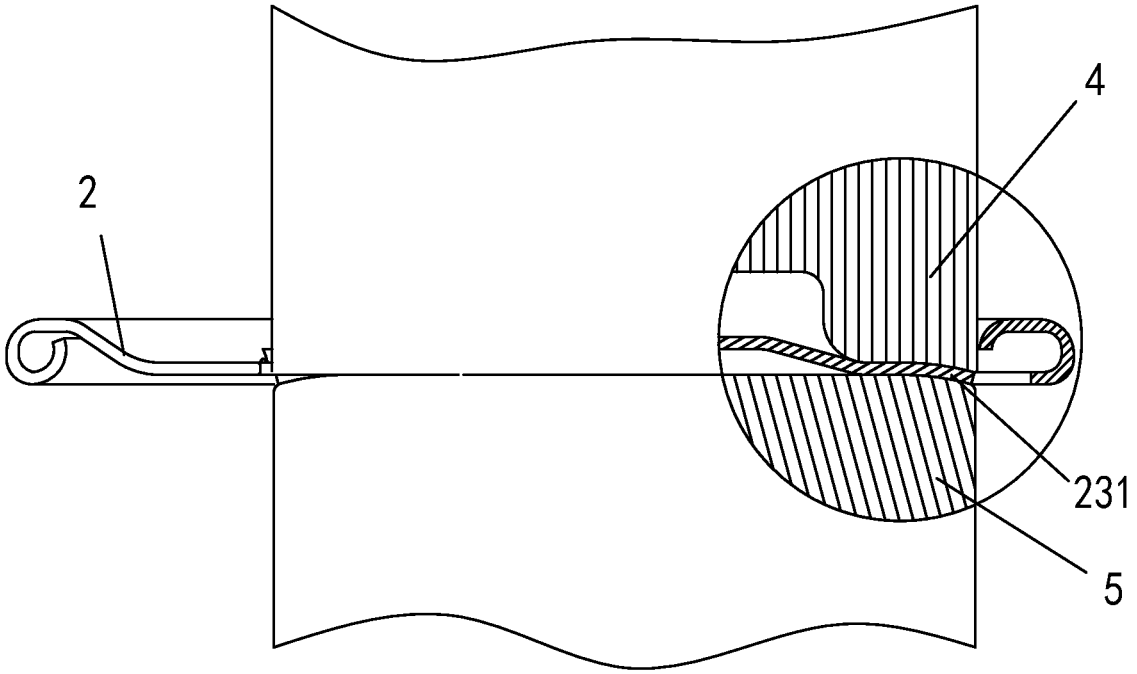
FIG. 12 is the view of formed arched deformation area of an embodiment of the present invention during production.

As shown in FIG. 12, it is the view of forming of the arched deformation area 231 of the tongue of the pull ring 23 and the die (upper die core 4 and lower die core 5) is used to stamp the edge of the tongue of the pull ring 23.

Figure 6:
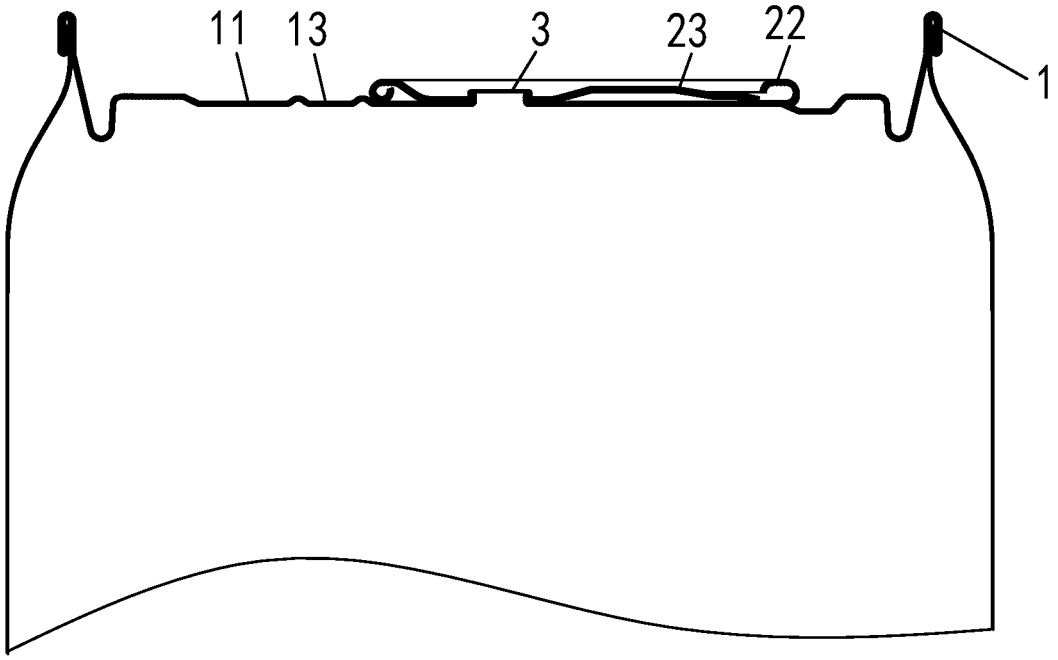
FIG. 6 is a schematic view of the first step of opening and resealing when the embodiment of the present invention is used.
Figure 7:
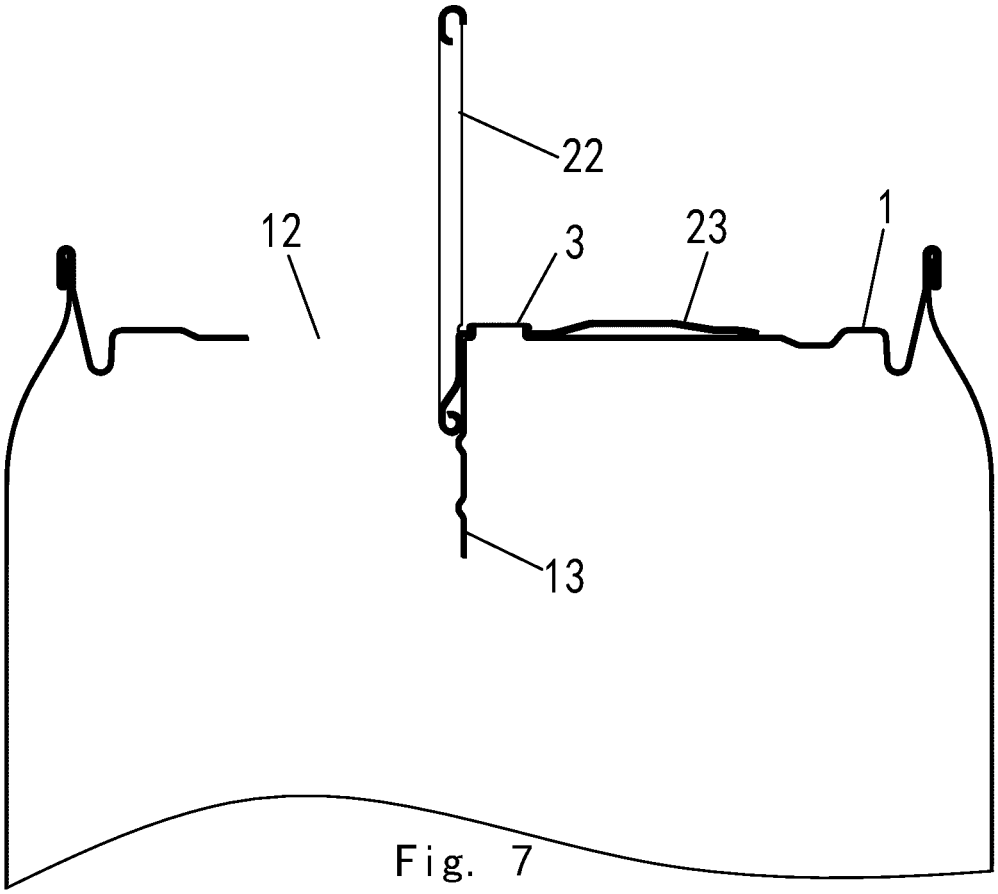
FIG. 7 is a schematic view of the second step of opening and resealing when the embodiment of the present invention is used.
Figure 8:
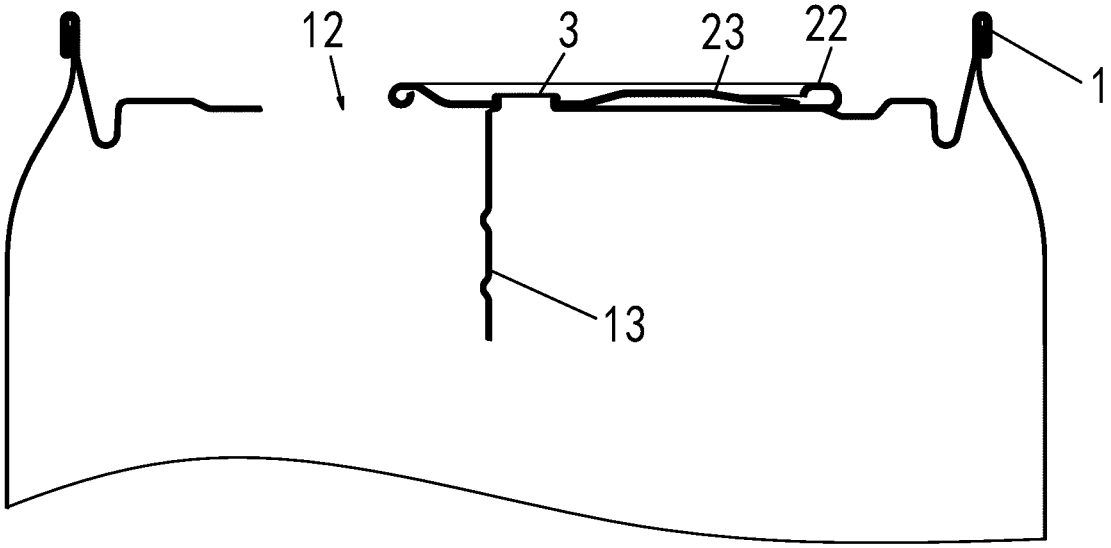
FIG. 8 is a schematic view of the third step of opening and resealing when the embodiment of the present invention is used.
Figure 9:
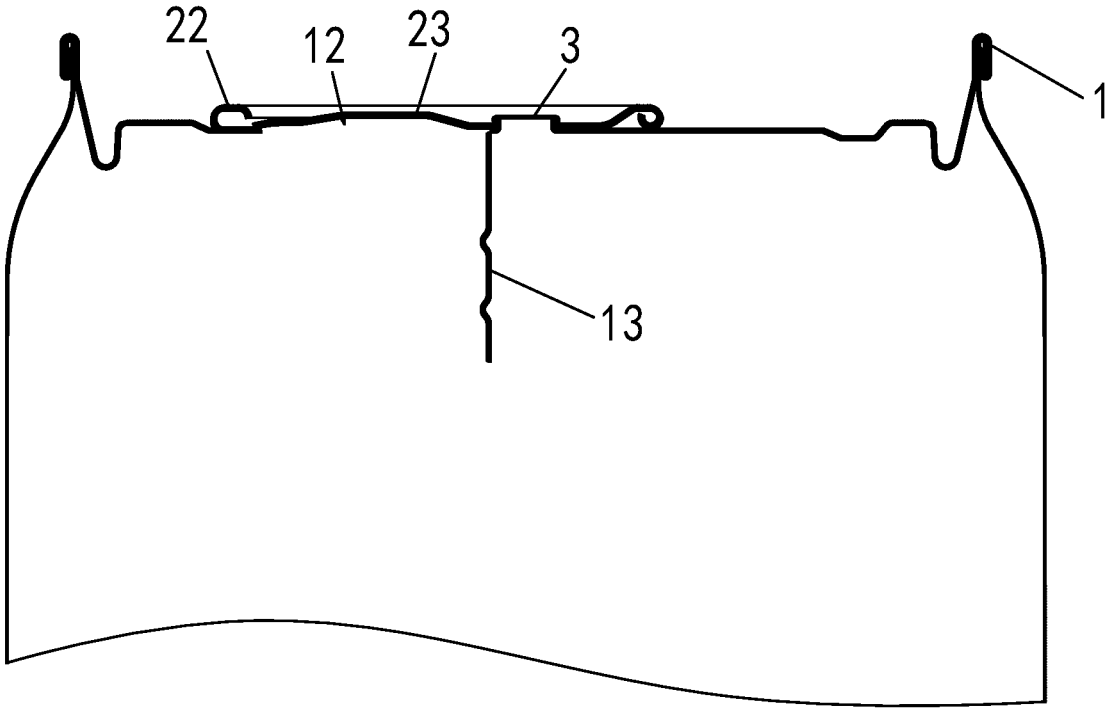
FIG. 9 is a schematic view of the fourth step of opening and resealing when the embodiment of the present invention is used.
Figure 10:
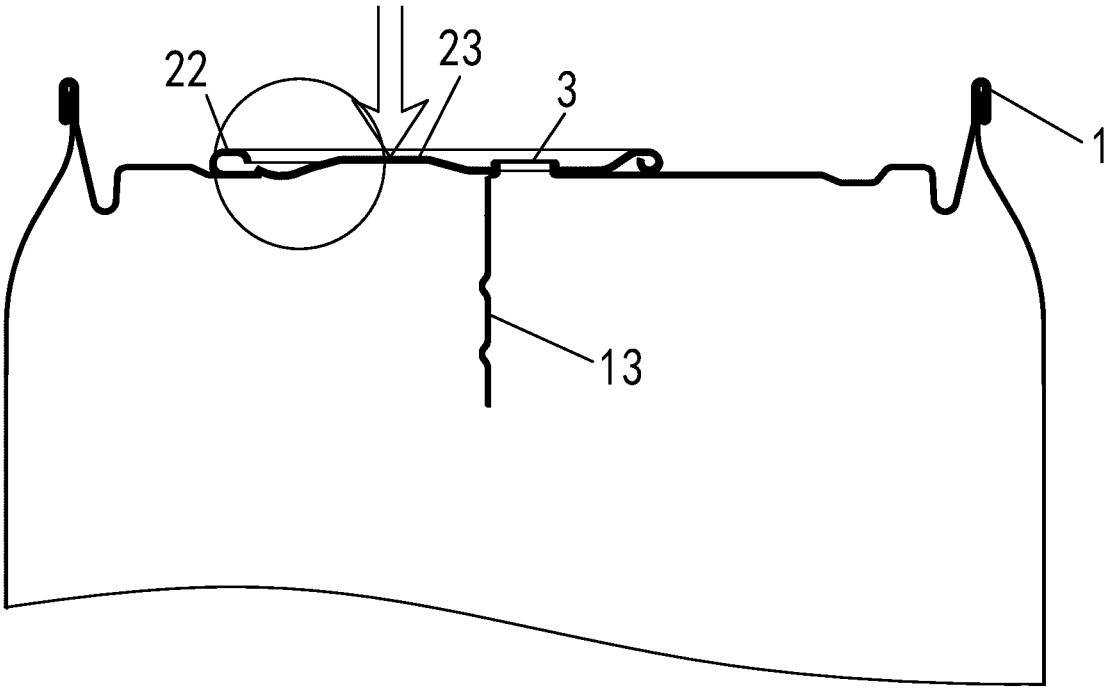
FIG. 10 is a schematic view of the fifth step of opening and resealing when the embodiment of the present invention is used.
Figure 11:
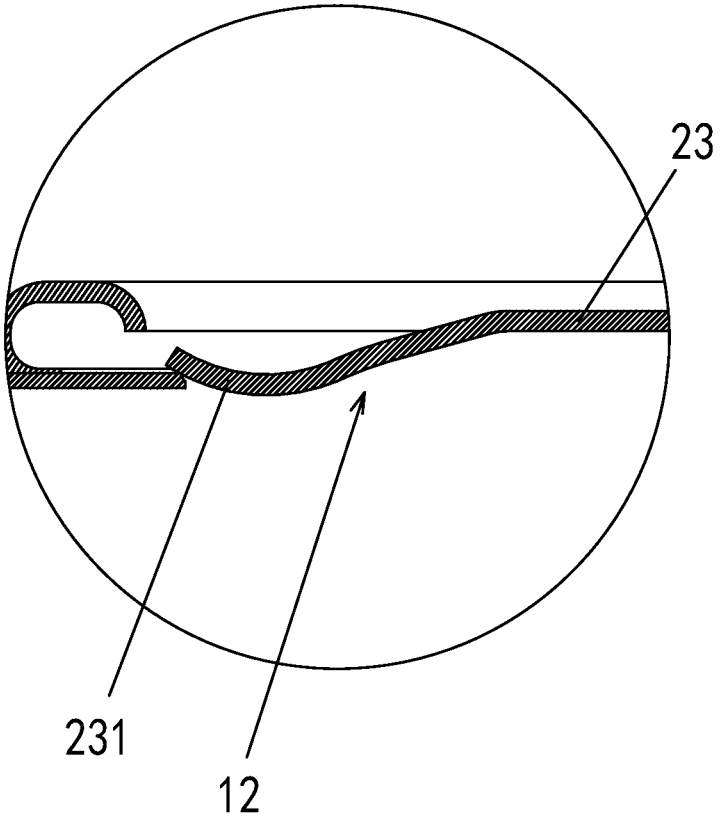
FIG. 11 is the enlarged view of position A in FIG. 10, which shows the state of the arched deformation area matching with the edge of the opening area after it's overturned during resealing.

The use process of this embodiment is shown from FIG. 6 to FIG. 11: The initially unopened can shell is shown in FIG. 6. When the lid is opened as shown in FIG. 7, pull up the ring body 22 of the pull ring 2 to make the front end action point of the pull ring 2 act on the tongue of the can shell 2 in the opening area 12 to break the main scribed line 11, and the tongue of the can shell 13 is turned down to be in the opened state; then turn down the ring body 22 of the pull ring 2 as shown in FIG. 8, so the beverage in the can shell can be drunk. When the lid is resealed as shown in FIG. 9, rotate the pull ring 2 to make the pull ring 2 rotate around the riveting point 3 by 180 degrees to make the tongue of the pull ring 23 cover the opening zone 12 as shown in FIG. 9; then, use the external force to press the middle part of the tongue of the pull ring 23 as shown in FIG. 10 (as shown by the arrow in the Figure), so that the arched deformation area 231 can be overturned upward and deformed to make the arched deformation area 231 contact with the edge of the opening area 12 as shown in FIG. 11 to seal the opening area 12 with the tongue of the pull ring 23.

It should be noted that the above-described embodiments are only for illustration of technical concept and characteristics of present invention with purpose of making those skilled in the art understand the present invention, and thus these embodiments shall not limit the protection range of present invention. The equivalent changes or modifications according to spiritual essence of present invention shall fall in the protection scope of present invention.

The invention claimed is:

1. A resealable easy open lid comprising:

a lid; and a pull ring riveted on the lid wherein:

the lid is provided with a main scribed line for opening the pull ring, an area surrounded by the main scribed line is an opening area and a part in the opening area is a tongue of a can shell, an acting point of a front end of the pull ring acts on the tongue of the can shell in the opening area as a first end of a lever, and a back end acts as a second end of the lever for a user to operate, the pull ring is made of a ring opening groove on a piece of sheet material, and an opening of the ring opening groove is toward the front end of the pull ring, so that a rear end of the pull ring is composed of an outer ring body and an inner tongue of the pull ring, the inner tongue of the pull ring is provided with an arched deformation area along an edge, and the arched deformation area is a ring opening belt along the ring opening groove, and its shape and size are matched with the shape and size of the opening area, the arched deformation area is an edge inclined to the an inner side of the lid which is formed by die stamping on the tongue of the pull ring, a middle part of the tongue of the pull ring is provided with an arch that arches outwards towards a cover, and when the pull ring is rotated around a riveting point to make the tongue of the pull ring cover an opening zone during resealing, and when the middle part of the tongue of the pull ring is pressed by external force, the arched deformation area is configured to be overturned and deformed to make it contact with an edge of the opening area to seal the opening area.

2. The resealable easy open lid according to claim 1, wherein a width of the arched deformation area accounts for 8% to 15% of a radial dimension of the tongue of the ring.

3. The resealable easy open lid according to claim 1, wherein a height at which the arched deformation area is inclined to the inner side of the lid is 0.8 to 2 times a thickness of the tongue of the pull ring.

* * * * *